US008820589B2

(12) United States Patent
Ghavami-Nasr et al.

(10) Patent No.: US 8,820,589 B2
(45) **Date of Patent: *Sep. 2, 2014**

(54) LIQUID DISPENSING APPARATUS

(75) Inventors: Ghasem Ghavami-Nasr, Salford (GB); Andrew John Yule, Salford (GB); Martin Laurence Burby, Salford (GB)

(73) Assignee: The University of Salford, Salford (GB)

( * ) Notice: Subject to any disclaimer, the term of this patent is extended or adjusted under 35 U.S.C. 154(b) by 307 days.

This patent is subject to a terminal disclaimer.

(21) Appl. No.: 12/901,102

(22) Filed: Oct. 8, 2010

(65) Prior Publication Data

US 2011/0101037 A1 May 5, 2011

Related U.S. Application Data

(60) Provisional application No. 61/260,052, filed on Nov. 11, 2009.

(30) Foreign Application Priority Data

Oct. 9, 2009 (GB) ..... 0917731.2
Apr. 1, 2010 (GB) ..... 1005567.1

(51) Int. Cl.
*B65D 83/00* (2006.01)
*B65D 83/42* (2006.01)
*B65D 83/54* (2006.01)

(52) U.S. Cl.
CPC ..... *B65D 83/54* (2013.01); *B65D 83/425* (2013.01)
USPC ..... 222/402.2; 222/335; 222/402.1; 222/402.24; 222/328

(58) Field of Classification Search
CPC ..... B65D 83/54; B65D 83/425; B65D 83/48
USPC ..... 222/402.2, 335, 402.1; 137/627.5
See application file for complete search history.

(56) References Cited

U.S. PATENT DOCUMENTS

| | | | | | |
|---|---|---|---|---|---|
| 2,723,055 | A | * | 11/1955 | Beard, Jr. | 222/402.2 |
| 3,018,928 | A | * | 1/1962 | Meshberg | 222/335 |
| 3,169,677 | A | * | 2/1965 | Focht | 222/402.2 |
| 3,394,851 | A | | 7/1968 | Gorman | |
| 4,953,759 | A | | 9/1990 | Schmidt | |
| 5,037,013 | A | | 8/1991 | Howlett | |
| 5,183,187 | A | | 2/1993 | Martin et al. | |

FOREIGN PATENT DOCUMENTS

| | | | |
|---|---|---|---|
| EP | 0 352 915 | A1 | 1/1990 |
| EP | 0 867 232 | A3 | 9/1998 |
| WO | WO-95/11841 | A1 | 5/1995 |
| WO | WO-2004/041340 | A2 | 5/2004 |
| WO | WO-2005/018690 | A1 | 3/2005 |
| WO | WO-2007/045826 | A1 | 4/2007 |

* cited by examiner

*Primary Examiner* — Paul R Durand
*Assistant Examiner* — Jeremy W Carroll
(74) *Attorney, Agent, or Firm* — Tarolli, Sundheim, Covell & Tummino LLP

(57) ABSTRACT

A discharge assembly for discharging a metered volume of a liquid held in a pressured container includes an elongate tubular housing, a valve stem having a body locating within the housing, a chamber provided within the body of the valve stem and having a liquid inlet, and a liquid discharge element moveable along the chamber from a liquid primed position to a liquid discharged position to effect discharge of the metered volume of liquid, wherein a second fluid transfer passageway is formed along the outside of the valve stem between the inlet of the housing and the first fluid transfer passageway, and a seal is provided for relative sliding movement onto a seat as the valve stem moves to close the second fluid transfer passageway to fluid flow.

20 Claims, 5 Drawing Sheets

LIQUID DISPENSING APPARATUS

RELATED APPLICATIONS

This application claims priority from British Patent Application No. GB 0917731.2, filed Oct. 9, 2009, U.S. Provisional Patent Application No. 61/260,052, filed Nov. 11, 2009 and British Application No. GB 1005567.1, filed Apr. 1, 2010, the subject matter of which is incorporated herein by reference.

FIELD OF INVENTION

The present invention relates to liquid dispensing apparatus for discharging a metered volume of a liquid. The invention relates more particularly (but not necessarily exclusively) to such an apparatus in the form of an aerosol dispensing apparatus.

BACKGROUND TO INVENTION

Two broad approaches exist to the self-propelled delivery of liquid from within an aerosol, being: (i) propulsion by means of a gas dissolved under pressure into solution with the liquid, and; (ii) the provision of substantially insoluble compressed gas within the aerosol container. Aerosol apparatus using a dissolved gas propellant (e.g. liquid natural gas, such as butane) rely upon flash-vaporisation of the dissolved gas out of the solution as a result of the pressure drop that occurs upon dispersal from the pressurised aerosol container into the atmosphere. Alternatively propulsion may be provided by an insoluble compressed gas (e.g. nitrogen, carbon dioxide or air) that is used to eject the liquid from the body of the aerosol container.

Many medical, air-freshener, insecticide and disinfectant aerosol applications require the delivery of volume metered doses from an aerosol container, and metered aerosol valves have been disclosed with respect to both methods of propulsion.

In the case of dissolved gas propellant, metered quantities of the propellant-liquid solution can be received into a metering chamber from the body of the aerosol container during a charging stage, before then being released to the atmosphere during a discharging stage, with the vaporisation of the dissolved gas (know as "flash vaporisation") driving the metered dose out of the metering chamber and into the atmosphere. The dissolved propellant used in such aerosol apparatus is typically butane, and the release of butane into the atmosphere has detrimental environmental and cost implications, as well as creating a fire safety risk. The avoidance of having to use such volatile propellants would be of significant environmental relevance.

Due to the relatively incompressible nature of the delivery liquid, a metered dose of delivery liquid will not automatically self-eject from a metering chamber. Accordingly several approaches have been used to drive the necessary ejection.

In one approach aerosol valves have been designed that bleed-off a quantity of compressed gas from the aerosol container into the metering chamber, which can then drive the accompanying liquid out of the chamber during discharge. Such a device is described in U.S. Pat. No. 3,394,851. However, such devices deplete the gas pressure within the aerosol container, thus requiring a high gas to liquid ratio with implications for manufacturing costs.

An alternative approach has used an elastomeric membrane as part of the metering chamber, which is distended during charging of a metering chamber, and which then collapses back into the chamber during the discharge stage driving the liquid contents from the metering chamber. A further related approach is known that uses a resilient bellows. Such devices are described in U.S. Pat. No. 4,953,759, U.S. Pat. No. 5,037,013 and WO9511841. Metering valves that use such resilient walls are liable to suffer from performance variations due to material variations of the resilient walls, associated implications for manufacturing yield, as well as vulnerability to reduced performance over lifetime due to deterioration of the resilient wall material.

According to a first aspect of the present invention there is provided a discharge assembly for discharging a metered volume of a liquid held in a pressured or pressurisable container, said assembly comprising (i) an elongate tubular housing having a liquid inlet at a first end thereof, (ii) a valve stem having a body locating within said housing and having a portion projecting from the second end of said housing, said valve stem being axially moveable relative to the housing between a first limit portion at which the assembly is closed to liquid discharge and a second limit position for discharge of the metered volume, (iii) a chamber provided within the body of the valve stem and having a liquid inlet at a first end of the chamber adjacent said first end of the housing and a first fluid transfer passageway towards the opposite, second end of the chamber, said first fluid transfer passageway providing communication between the chamber and the exterior of the valve stem, and (iv) a liquid discharge element moveable along said chamber from a liquid primed position to a liquid discharged position to effect discharge of the metered volume of liquid, wherein (a) the exterior of the body of the valve stem and the interior of the housing are configured such that in the first position of the valve stem there is second fluid transfer passageway along the outside of the valve stem between the inlet of the housing and said first fluid transfer passageway, and (b) a seal is provided for relative sliding movement onto a seat as the valve stem moves from its first to second position to close said second fluid transfer passageway to fluid flow.

According to a second aspect of the present invention there is provided a discharge assembly in accordance with the first aspect of the invention, further comprising a pressurised or pressurisable container, for discharging a metered volume of a liquid held in the pressurised container.

According to a third aspect of the present invention there is provided a liquid dispensing apparatus with a discharge assembly for discharging a metered volume of a liquid held in a pressurised container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position.

It will be appreciated that the liquid discharge assembly of the first aspect of the invention is particularly suitable for use in the liquid dispensing apparatus as defined in the third aspect of the present invention. Therefore according to a preferred embodiment of the first aspect of the invention, there is provided a liquid dispensing apparatus with a discharge assembly for discharging a metered volume of a liquid held in a pressurised container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position wherein the discharge assembly is in accordance with the first aspect of the present invention.

In accordance with the invention therefore a metered volume of a liquid is dispensed from the apparatus by means of a liquid discharge element which is moved along a metering chamber (to effect the discharge) by the pressure within the container. Advantageously, the present invention provides compressed gas propelled liquid dispensing apparatus that delivers uniform metered volumes of liquid propellant over lifetime, is inexpensive to manufacture, is manufacturable within narrow performance tolerances with high manufacturing yield, and has componentry resistant to the effects of ageing over product lifetime. Further, the present invention produces a high quality liquid aerosol without requiring a gas bleed from the aerosol container, thereby substantially maintaining aerosol spray performance throughout operational lifetime.

The apparatus in accordance with the invention is preferably in the form of an aerosol spray device.

The liquid discharge element employed in the liquid dispensing apparatus of the invention is preferably rigid to ensure that a known volume of liquid is dispensed without possible fluctuation in volumes as between successive discharges due to flexibility of the liquid discharge element.

In preferred constructions of apparatus in accordance with the invention, the apparatus is configured such that movement of the liquid discharge element (which is preferably in the form of a cylindrical piston or ball) from its liquid primed position in the metering chamber to its liquid discharged position is effected against the returning force. In other words, the returning force is applied during discharge of the apparatus and not only during recharging thereof. Conveniently the returning force is provided by virtue of the liquid discharge element being negatively buoyant in the liquid to be dispensed so that it has a tendency to "sink" within the metering chamber. The liquid discharge element may, for example, be of a metal such as stainless steel. Alternatively it may be of a synthetic polymeric material which is appropriately weighted (e.g. by means of metal inserts or by the incorporation therein of a densifying agent). Alternatively or additionally, the returning force may be provided by a spring.

The metering chamber is preferably provided within the valve stem with the liquid discharge element being moveable along an interior surface of the metering chamber. Preferably the liquid discharge element is in the form of a piston which is preferably spherical or cylindrical. If the apparatus is to be used for metering accurate volumes (e.g. for medical purposes) then the liquid discharge element may be sealed against the valve stem and/or against the inner wall of the metering chamber. Preferably, the clearance between the liquid discharge element and the metering chamber is sufficient to create a seal between the liquid discharge element and the metering chamber, but not too small that the travel of the liquid discharge element between the first and second limit position is significantly impeded by friction with the wall of the metering chamber.

A particular advantage of a sphere being the liquid discharge element as opposed to a cylindrical piston is that a sufficient seal is created between the liquid discharge element and the metering chamber, but friction between the wall of the metering chamber and the sphere is minimised, thus allowing the sphere to travel more freely than a cylindrical piston for example. Also, the manufacturing tolerances for a cylindrical piston are higher than a sphere because the sphere can roll and rotate within the chamber more freely than the former.

Preferred constructions of apparatus in accordance with the invention will be such that the liquid discharge element has a first side exposed to the metering chamber and an opposite second side exposed to fluid pressure from the container. In such an arrangement, the metering chamber will be provided on the first side of the liquid discharge element with an inlet/outlet arrangement for introduction of liquid from the container into the metering chamber and for discharge of liquid from the metering chamber. In some embodiments of the invention, the inlet and the outlet may be separate of each other. However in other embodiments of the invention a single port may serve as both an inlet and an outlet.

Generally apparatus in accordance with the invention will incorporate an actuator assembly incorporating a valve stem in which for the movement from a first limit position to a second limit position is preferably against biasing means (e.g. a coil spring). The actuator assembly preferably incorporates a valve stem. The actuator assembly may further incorporate an actuator cap.

In preferred embodiments of the invention, the valve stem has a discharge conduit arrangement with an inlet through which liquid is introduced into the discharge conduit arrangement and an outlet from which liquid is discharged from the apparatus. Such an embodiment also incorporates a valving arrangement which is such that wherein the valve stem is in its first limit position liquid may flow into the metering chamber from the pressurised container through the inlet/outlet arrangement to effect charging of the metering chamber and may not flow out of the metering chamber through the inlet/outlet arrangement. Conversely when the valve stem is in its second limit position, liquid may flow out of the metering chamber to the discharge conduit through the inlet/outlet arrangement to effect discharging of the metering chamber and may not flow into the metering chamber through the inlet/outlet arrangement.

A pressure equalising channel may be provided in the exterior surface of the metering chamber to allow for equalisation of the pressure in the discharge conduit arrangement of the valve stem and that in the container when the valve stem is in the first limit position.

The valve stem may be rotatable about its axis between first and second rotary positions and wherein the apparatus is such that axial movement of the valve stem beyond its second limit position is prevented in the first rotary position of the valve stem but allowed in the second rotary position thereof to provide for filling and/or re-filling of the apparatus. Advantageously the requirement of such rotation of the axis to enable filling and/or re-filling of the apparatus prevents accidental depression of the valve stem into the filling position by the user during normal use.

Locating the metering chamber within the valve stem has the advantage of simplifying construction as compared to the case where the metering chamber is provided around the valve stem (around the periphery thereof). Advantageously such a metering chamber may be particularly suitable for providing an apparatus with a metering chamber having a small and accurate metered volume. The valve stem may be biased from the second limit position to the first limit position, preferably with a spring, most preferably a coil spring.

Preferably, a lower wall of the housing is provided with a depending spigot defining an inlet for the housing. Liquid from the pressurised container preferably enters the housing through this spigot. Preferably the spigot extends from a lower wall of the housing and is capable of engaging with at least a portion of the valve stem. Preferably the coil spring is located on the spigot such that when the valve stem is in the second limit position, the spring biases the valve stem towards the first position.

Preferably a seal is provided at the end of the housing from which a portion of the valve stem projects. Preferably the seal is an annular seal which seals around the circumference of the valve stem at the point at which it exits the housing. The seal is such that it allows relative slidable movement of the valve stem within the housing and between the first and second limit positions.

Preferably the metering chamber has a substantially cylindrical cross section.

Preferably the liquid discharge element is spherical. Preferably the diameter of the liquid discharge element closely approximates that of the metering chamber, thereby providing a sealed or almost sealed contact with the internal circumference of the metering chamber.

Preferably the seal provided for relative sliding movement onto the seat is an annular seal. Preferably the seal is an O-ring. Preferably the O-ring is made of rubber or plastics material. Preferably the seal is at least partially recessed in an annular groove in the exterior of the body of the valve stem. Preferably the seal is provided on the exterior of the body of the valve stem and the seat is provided on the interior surface of the housing.

Preferably the seat is downwardly inclined away from the second end of the housing.

Preferably the liquid discharge element is moveable by a returning force from its liquid discharged position to its liquid primed position.

Preferably the liquid discharge element is negatively buoyant in the liquid to be dispensed so as to provide at least a part of said returning force.

Preferably the valve stem comprises a body portion and a narrower diameter head portion. The head portion is preferably encircled at its base by a shoulder defined at the upper end of the body. The head portion is preferably moveable within an annular seal provided at the second end of the housing. Preferably the head portion has a third fluid transfer passageway communicating with an outlet of the head portion, said third transfer passageway being external of the housing in the first position of the valve stem and within the housing in the second position thereof. Preferably the inlet to the housing is coaxial with the chamber.

Preferably the discharge assembly of the invention is such that with the valve stem in its second limit position and the discharge element at its liquid primed position there is a refill flow passageway arrangement between the liquid inlet of the housing and the chamber provided within the body of the valve stem to permit re-filling of a container on which the discharge assembly is mounted in use. Preferably the discharge assembly comprises a tubular projection within the elongate tubular housing around the liquid inlet thereof, and the refill passageway arrangement is provided by at least one passageway in the wall of said tubular projection and at least one passageway in the wall of the chamber accessible to fluid when the discharge element is at its liquid primed position.

Alternatively or additionally, the chamber may be provided with a bore having differential diameters along its length. A first diameter of bore is provided which closely approximates the diameter of the liquid discharge element so as to provide a seal between the chamber and the liquid discharge element. A second diameter, larger than the first diameter, may also be provided with which the liquid discharge element does not form a seal. This allows fluid to flow around the liquid discharge element (particularly in the embodiment where the liquid discharge element is a ball) when the liquid discharge element is at the position of the larger diameter bore. Preferably, the larger diameter bore is present along a portion of the length of the chamber, and is bounded on either side by the first diameter bore.

Preferably the apparatus of the present invention comprises:

(i) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus, and (ii) a valving arrangement such that when the valve stem is in its first limit position liquid may not flow out of the metering chamber through the inlet/outlet arrangement into the discharge conduit and when the valve stem is in its second limit position liquid may flow out of the metering chamber through the inlet/outlet arrangement into the discharge conduit.

In this embodiment, the discharge assembly preferably comprises a housing and wherein (i) an annular space is provided between the inner surface of the housing and the outer surface of the valve stem, and (ii) the metering chamber comprising the liquid discharge element is provided internally to the valve stem.

In this embodiment, the discharge assembly preferably comprises the following features:

(i) the housing is an elongate tubular housing having a liquid inlet at a first end thereof, (ii) the valve stem has a body locating within said housing and having a portion projecting from the second end of said housing, (iii) the metering chamber has a liquid inlet at a first end of the chamber adjacent said first end of the housing and a first fluid transfer passageway towards the opposite, second end of the chamber, said first fluid transfer passageway providing communication between the chamber and the exterior of the valve stem, (iv) the exterior of the body of the valve stem and the interior of the housing are configured such that in the first position of the valve stem there is second fluid transfer passageway along the outside of the valve stem between the inlet of the housing and said first fluid transfer passageway, and (v) the valving arrangement comprises a seal provided for relative sliding movement onto a seat as the valve stem moves from its first to second position to close said second fluid transfer passageway to fluid flow.

The invention will be further described by way of example only with reference to the accompanying drawings, in which.

Figure 1A:
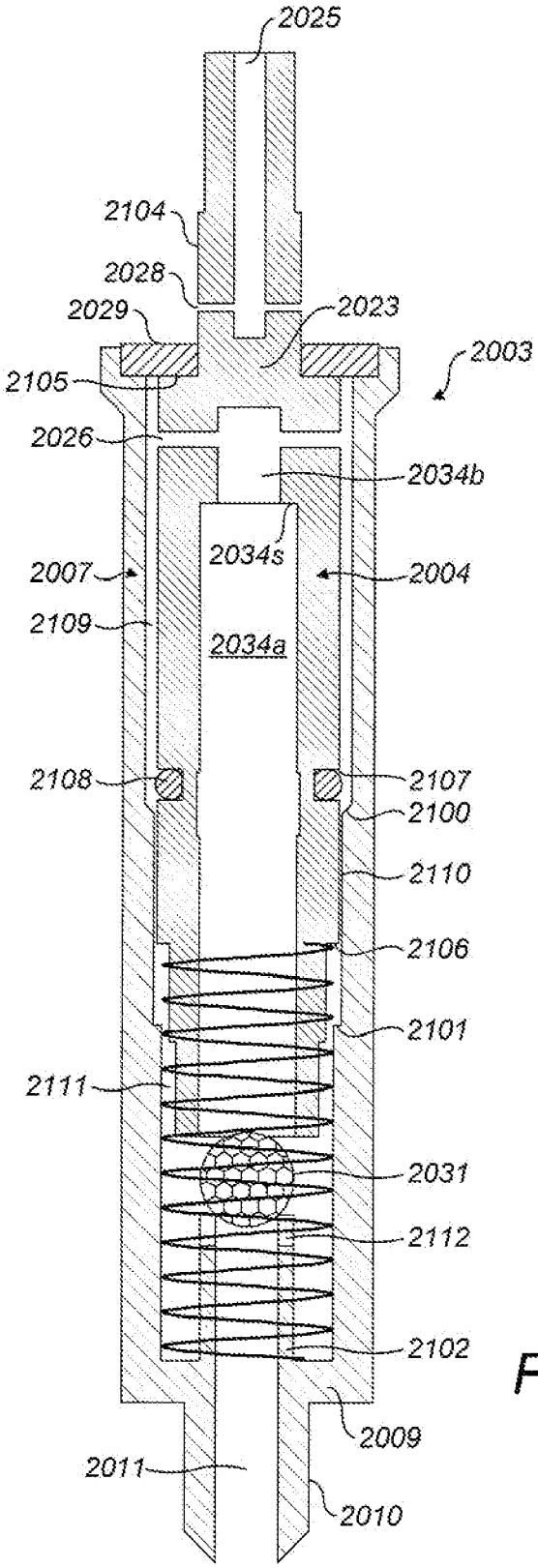
FIGS. 1A and 1B show one embodiment of discharge assembly in successive stages of operation in accordance with the first aspect of the invention.

In the following description, references to "upper" and "lower" are to the embodiments of apparatus as illustrated in the drawings which are represented in their normal operational positions. In the following description, the "rest" condition is that in which the apparatus is primed and ready to emit a metered volume, with the valve stem in the uppermost position and the piston in the lower limit position.

In the following description, references to the valve stem being in the uppermost and lowermost positions correspond respectively with references to the valve stem being in first and second limit positions. References to the valve stem being in the depressed position correspond with references to the valve stem being in the lowermost position. References to piston correspond with references to liquid discharge element. References to the lower and upper limit positions correspond respectively with references to liquid primed and liquid discharged positions.

It should be appreciated that other than substantially insoluble compressed gas propellants, liquefied gas propellants may be used in the embodiments of the invention.

It will be appreciated that the liquid discharge assembly according to the first aspect of the invention is particularly suitable for use in the liquid dispensing apparatus as generally defined herein. Therefore according to a further aspect of the present invention there is provided a liquid dispensing apparatus with a discharge assembly for discharging a metered volume of a liquid held in a pressurised or pressurisable container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position wherein the discharge assembly is in accordance with the first aspect of the present invention.

Preferred features of the discharge assembly of the first aspect of the present invention are defined in the claims of the present specification which will be understood from a consideration of the subsequent description of this specification.

Referring now to FIG. 1A, there is shown therein an embodiment of discharge (or metering valve) assembly 2003 in accordance with the first aspect of the invention and in its rest condition.

The metering valve assembly 2003 comprises a housing 2007 within which valve stem 2004 is located. Housing 2007 is generally tubular and has an inner surface that is stepped at two positions along its length. More particularly, the inner surface of housing 2007 has a downwardly inclined, annular step 2100 and a right angled step 2101 further down towards the wall 2009 at the lower end of the housing.

Lower wall 2009 is provided with a depending spigot 2010 defining an inlet 2011 for the housing 2007. Spigot 2010 may optionally have an enlarged lower end (not shown) on which is located the upper end of a dip-tube (not shown) that extends to the lower region of a container (not shown) onto which the metering valve assembly 2003 is mounted in use. An upstanding tubular spigot 2102 encircles the inlet 2011 and projects upwardly into the interior of the housing 2007.

Valve stem 2004 comprises a body portion 2103 and a narrower diameter head portion 2104 encircled at its base by a shoulder 2105 defined at the upper end of body 2103. At the junction of body portion 2103 and head portion 2104 is a partition wall 2023 which separates an upper, open-topped conduit 2025 (in head portion 2104) from lower chambers 2034*a* and 2034*b* provided in body portion 2103. As shown, chamber 2034*b* is the upper of these two chambers and of lesser diameter whereby a shoulder 2034*s* is defined in going from chamber 2034*a* to 2034*b*.

Over the majority of its length, body portion 2103 of valve stem 2004 has an outer diameter marginally less than the inner diameter of housing 2007 in the region thereof between steps 2100 and 2101. In its lower region, body portion 2103 is stepped inwardly as at 2106.

Valve stem 2004 is provided with two sets of fluid transfer passageways, one set extending radially outwardly from the discharge conduit 2025 and the other set radially outwardly from chamber 2034*b*. More particularly, in its upper region, the body 2103 (of the valve stem 2004) is formed with first fluid transfer passageways 2026 and a lower region of the head portion 2104 is formed with second fluid transfer passageways 2028.

Additionally, body portion 2103 (of the valve stem 2004) is formed with an annular groove 2107 in which locates an O-ring 2108. The external diameter of O-ring 2108 is less than the internal diameter of housing 2007 above step 2100 but slightly greater than the internal diameter below step 2100.

Figure 1B:
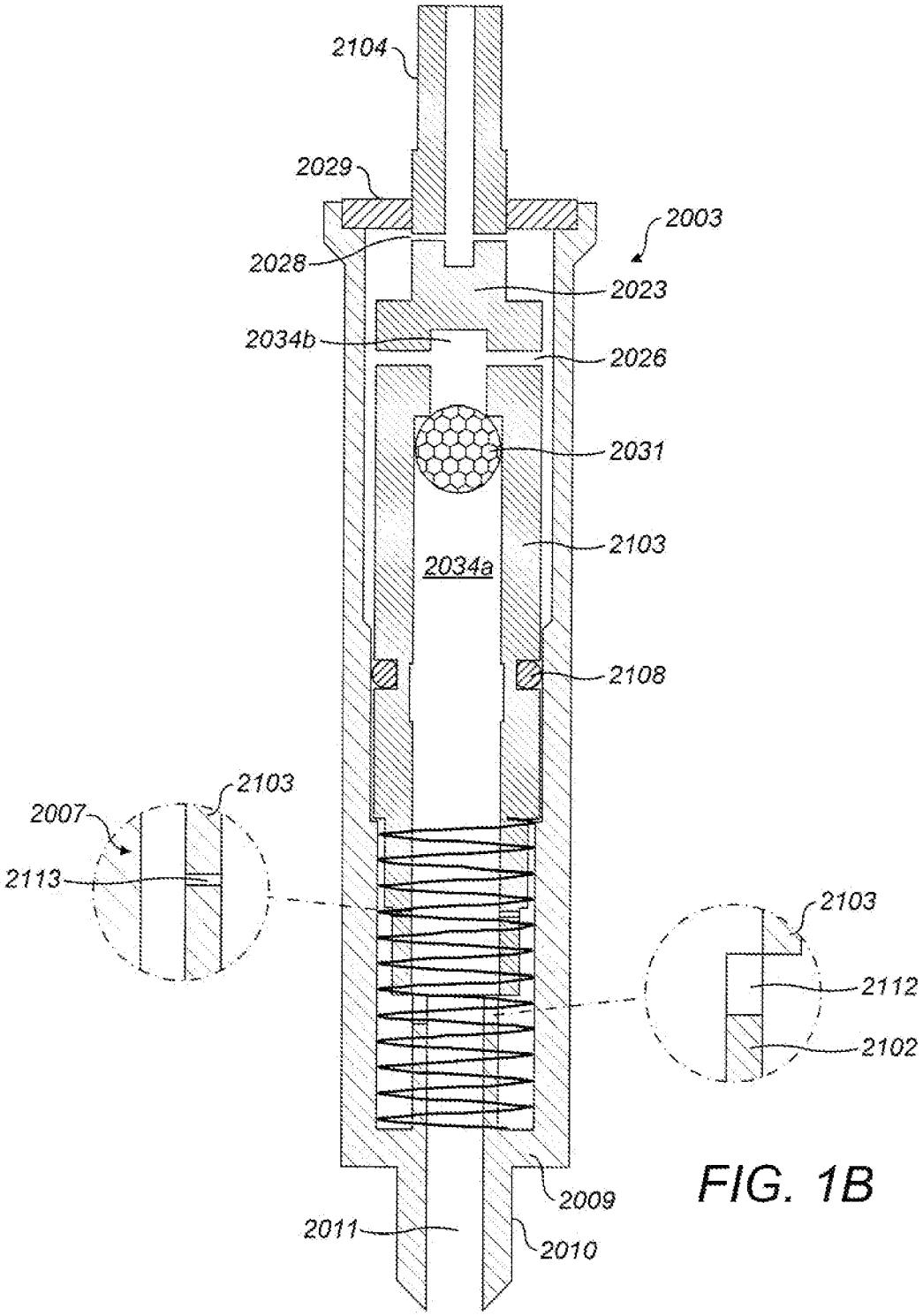

As shown in FIGS. 1A and 1B, valve stem 2004 is located with its body 2103 within housing 2007 and its head 2104 projecting beyond an annular seal 2029 which is provided at the upper end of housing 2007 and seals against the external surface of the head 2104. As further shown in the drawings, the body 2103 of valve stem 2004 sub-divides the interior volume of housing 2007 into a first annular region 2109 above step 2100, a narrower second annular region 2110 between steps 2100 and 2101 and a third annular region 2111 below step 2101.

Valve stem 2004 is of a length such that, when the metering assembly 2003 is in its rest condition (as shown in FIG. 1A) the lower end of valve stem 2004 locates above the upper end of spigot 2102. A coil spring 2002 provided around spigot 2102 and around the lower end of valve stem 2004 serves to bias the latter to its upper position.

A ball 2031, which is negatively buoyant relative to liquid held within a container for discharge by the assembly 2003 is provided as shown. Ball 2031 has a diameter greater than the internal diameter of tubular spigot 2102 but such as to locate with minimal clearance within lower chamber 2034*a* of valve stem 2004. In the rest condition of the assembly 2003 (see FIG. 1A), ball 2031 rests on the upper end of tubular spigot 2102 with its upper surface lying just within the lower end of chamber 2034*a*.

With the arrangement as described, ball 2031 is capable of travel between a lower limit position (defined by the upper end of tubular spigot 2102) and an upper limit position at shoulder 2034*s*. Accordingly the lower chamber 2034*a* provides a metering chamber within which ball 2031 is able to move from its lower to upper limit position to sweep out a metered volume.

Further features of the illustrated embodiment are cutaway portions 2112 at the upper end (as seen in FIGS. 1A and 1B) of the spigot 2102 and slots 2113 or other passageways for providing fluid flow radially through the wall towards the lower end of the body portion 2102. More particularly, the slots 2113 (or other passageways) are provided at a level such that with the valve stem 2004 in the depressed position (FIG. 1B) and the ball 2031 seated on the spigot 2102, fluid is able to flow radially outwardly of the body 2013 of valve stem 2004 for the reasons described more fully below.

Figure 2A:
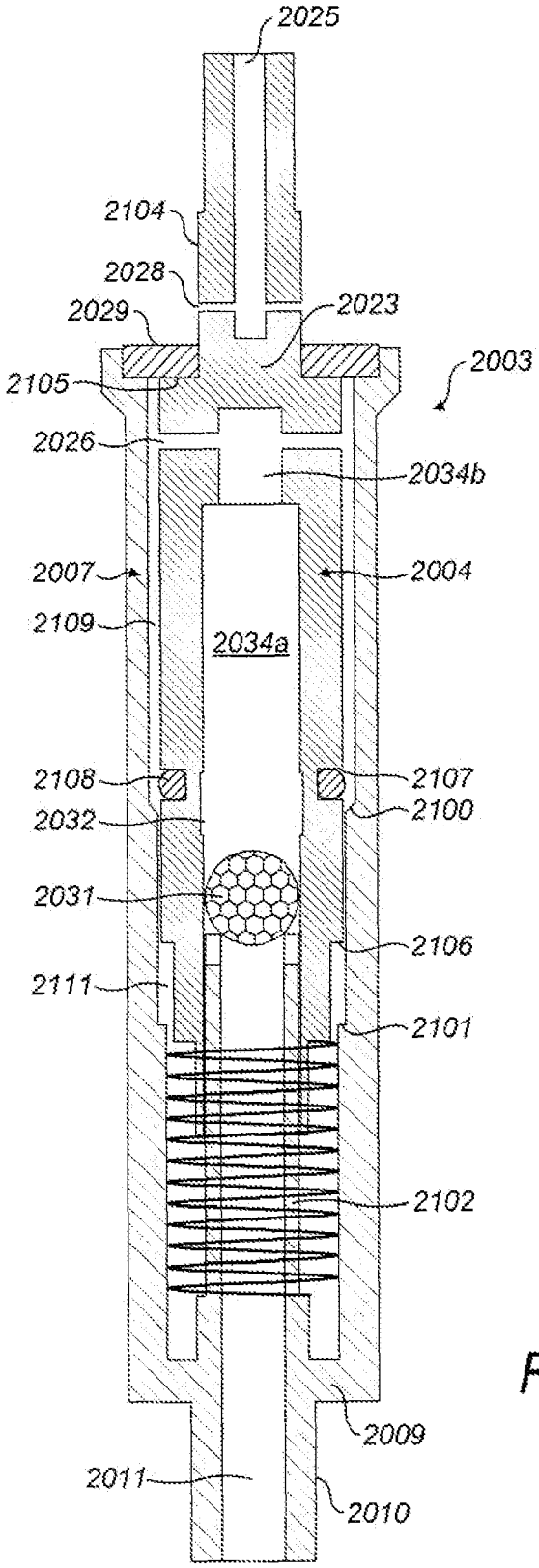
FIGS. 2A, 2B and 2C show a further embodiment of discharge assembly in successive stages of operation in accordance with the first aspect of the invention.
Figure 2B:
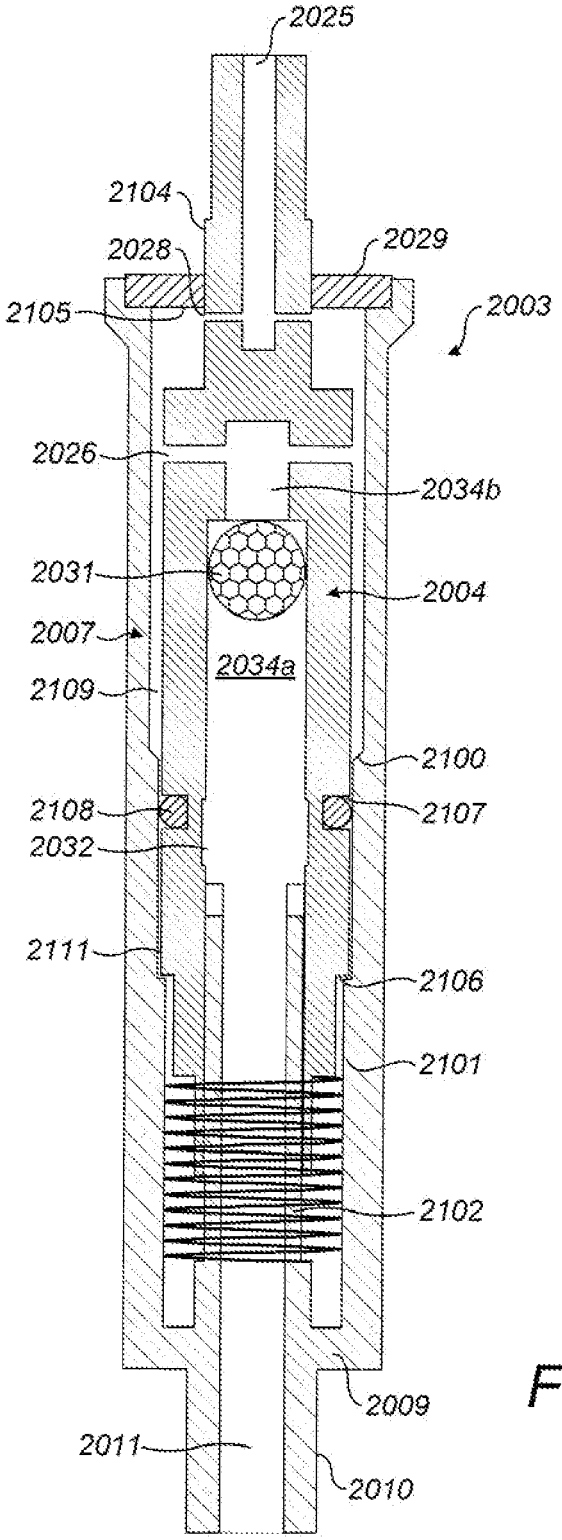

FIGS. 2A and 2B shows a similar embodiment to that shown in FIGS. 1A and 1B. In this embodiment, valve stem 2004 is of a length such that, when the metering assembly 2003 is in its rest condition (as shown in FIG. 2A) the lower end of valve stem 2004 locates below the upper end of spigot 2102. The spigot can be slidably inserted into the lower end of valve stem 2004. A coil spring 2002 provided around spigot 2102 and around the lower end of valve stem 2004 serves to bias the latter to its upper position.

Figure 2C:
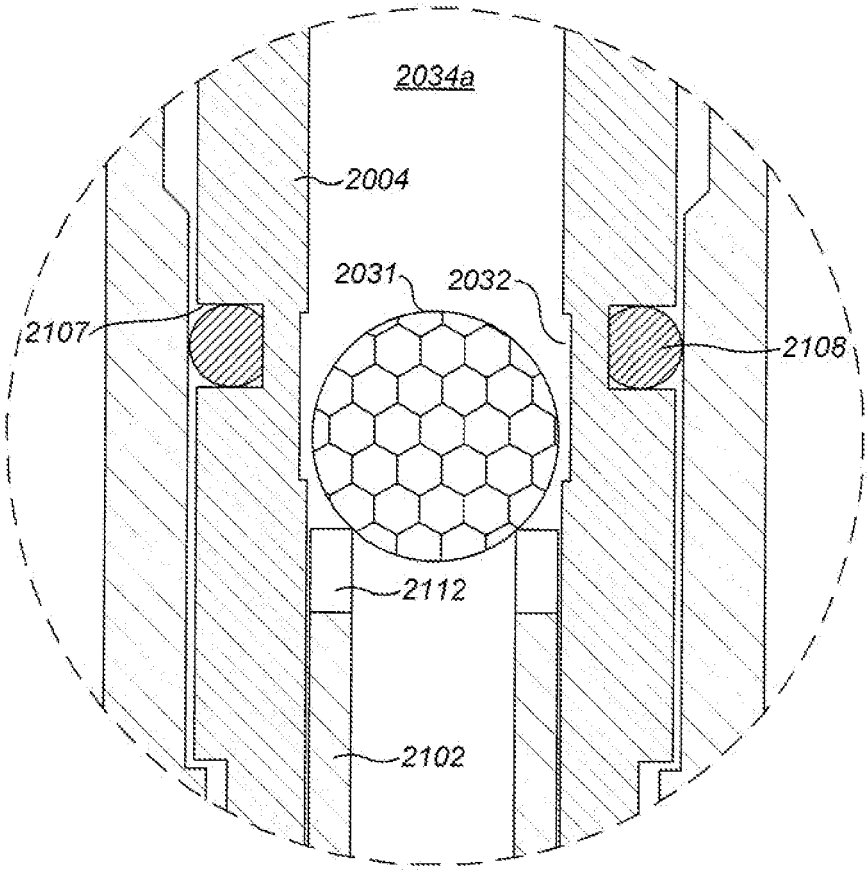

Furthermore, FIGS. 2A and 2B shows that the wall of the chamber 2034*a* has an annular groove 2032 which has a greater diameter than the rest of the chamber. This is shown in greater detail in FIG. 2C. FIG. 2 C shows that how the annular grove 2032 facilitates refilling of the apparatus. Firstly, the valve stem 2004 is depressed so as to be in the position shown in FIG. 2B. It can then be depressed past this position (for example by rotating the valve stem to a predetermined position) and depressed further such that the upper end of the spigot 2102 will hold the ball 2031 adjacent to the annular groove (as shown in FIG. 2C). Secondly, a pressurised source of liquid and/or propellant gas (as the case may be) is connected to (what would normally be) the outlet end of valve stem 2004. As a result, the refill liquid and/or propellant gas passes along discharge conduit 2025, radially outwardly through the second fluid transfer passageways 2028 into the annular region 2109 before passing radially inwardly through passageways 2026. The fluid pressure causes the ball 2031 to move to the position shown in FIG. 2C. The pressurised refill liquid and/or propellant gas passes along chamber 2034*a*, past the ball 2031 at the annular groove, and then radially through the slots 2112 so it may pass into the container through the passageway.

With regard to the embodiment shown in 2A-2C, the clearance between the outer diameter of the spigot 2102 and the inner wall of the metering chamber 2034*a* is sufficient to allow a flow of fluid from the metering chamber 2034*a* to the annular space 2111, and hence provide fluid communication between the metering chamber 2034*a* and the fluid flow transfer passageways 2026 when the ball 2031 is in the liquid discharged position as shown in FIG. 2B. This permits equalization of the pressure between the pressurised container and the upper chamber 2034*b*, thus facilitating the movement of the ball 2031 back towards the spigot 2102.

Operation of the illustrated device according to FIGS. 1A and 1B is as follows.

In the "rest" condition illustrated in FIG. 1A, the ball 2031 is at its lower limit position and the metering valve assembly 2003 is filled with liquid up to the level of seal 2029. Once valve stem 2004 is depressed, the fluid transfer passageways 2028 move downwardly past the seal 2029 so as to be open to fluid flow from within the housing 2007. Additionally O-ring 2108 now acts against the inner surface of second annular region 2110 so as to prevent fluid flow from the inlet 2011 into the first annular region 2109. Ball 2031 is now forced upwardly by fluid pressure so that it moves from its lower limit position (shown in FIG. 1A) to its upper limit position (shown in FIG. 1B) and in doing so causes a metered volume of liquid to be transferred radially outwardly through fluid flow transfer passageways 2026 and then radially inwardly through fluid flow transfer passageways 2028 for discharge by the assembly. Once the valve stem 2004 is released and it returns to its uppermost position under the action of spring 2022, the fluid transfer passageway 2008 again become closed to fluid flow (by virtue of locating above seal 2029) but liquid is now able to pass from the inlet 2011 of the housing along the annular regions 2109, 2110 and 2111 to reach the fluid transfer passageways 2026. This liquid is able to pass radially inwardly along fluid transfer passageways 2026 above the level of ball 2031, which will now move downwardly to its lower limit position so that chamber 2034*a* is primed for a further discharge of a metered volume of liquid.

Once the container on which the spray discharge assembly is mounted has been depleted of liquid and gas it may be refilled in the following manner. Firstly, the valve stem 2004 is depressed so as to be in the position shown in FIG. 1B. Secondly, a pressurised source of liquid and/or propellant gas (as the case may be) is connected to (what would normally be) the outlet end of valve stem 2004. As a result, the refill liquid and/or propellant gas passes along discharge conduit 2025, radially outwardly through the second fluid transfer passageways 2028 into the annular region 2109 before passing radially inwardly through passageways 2026. If the ball 2031 is not already seated on spigot 2031, the fluid pressure causes it to move to this position. The pressurised refill liquid and/or propellant gas passes along chamber 2034*a* and then radially outwardly through the slots 2113 and subsequently radially inwardly through the cut-away portions 2112 so it may pass into the container through the passageway.

It will be appreciated that the device shown in FIGS. 2A-2C works analogously to FIGS. 1A and 1B. The principal difference is that pressure equalization between the pressurised container and the upper chamber 2034*b* is facilitated by the fluid being able to move between the interface of the outer surface of the spigot 2102 and the inner surface of the metering chamber 2034*a*. This may be achieved by providing adequate clearance between the outer diameter of the spigot 2102 and the inner diameter of the metering chamber 2034*a*. This may be alternatively or additionally achieved by providing grooves in the outer surface of the spigot 2102 which provide one or more conduits which run between the metering chamber 2034*a* and the annular regions 2111.

The apparatus of the present invention may be used as an aerosol spraying device. Such a device may be used to deliver various materials, preferably materials dissolved or dispersed in water. For example, the liquid in the container may contain a range of materials selected from the group consisting of pharmaceutical, agrochemical, fragrance, air freshener, odour neutraliser, sanitizing agent, depilatory chemical (such as calcium thioglycolate), epilatory chemical, cosmetic agent, deodorant, anti-perspirant, anti-bacterial agents, anti-allergenic compounds, and mixtures of two or more thereof. Furthermore, the container may contain a foamable composition, optionally containing any of the materials disclosed immediately hereinbefore. The water in the container may optionally contain one or more organic solvents or dispersants in order to aid dissolution or dispersion of the materials in the water.

The apparatus of the present invention may be used with an apparatus having a dispensing mechanism which turns on and off periodically. This may be automated.

For example, the apparatus of the present invention may be used to provide an air treatment agent to an air treatment device comprising: an airborne agent detector comprising one or more airborne agent sensors, wherein the airborne agent detector comprises means to detect a threshold level or concentration of an airborne agent; a means to mount the apparatus of the present invention (including the pressurised container where present) to the device; and a means to expel a portion of air treatment agent from the apparatus of the present invention, upon detection of an airborne agent by the detector. Such an air treatment device (not including the apparatus of the present invention) is disclosed in WO 2005/018690 for example. Alternatively, the apparatus of the present invention may be used to dispense a composition from a spraying device as disclosed in WO 2007/045826.

The invention claimed is:

1. A discharge assembly for discharging a metered volume of a liquid held in a pressurised or pressurisable container, said assembly comprising:

(i) an elongate tubular housing having a liquid inlet at a first end thereof, (ii) a valve stem having a body locating within said housing and having a portion projecting from the second end of said housing, said valve stem being axially moveable relative to the housing between a first limit portion at which the assembly is closed to liquid discharge and a second limit position for discharge of the metered volume, (iii) a chamber provided within the body of the valve stem and having a liquid inlet at a first end of the chamber adjacent said first end of the housing and a first fluid transfer passageway towards the opposite, second end of the chamber, said first fluid transfer passageway providing communication between the chamber and the exterior of the valve stem, and (iv) a liquid discharge element moveable along said chamber from a liquid primed position to a liquid discharged position to effect discharge of the metered volume of liquid, wherein (a) the exterior of the body of the valve stem and the interior of the housing are configured such that in the first position of the valve stem there is second fluid transfer passageway along the outside of the valve stem between the inlet of the housing and a head portion of said valve stem, and (b) a seal is provided for relative sliding movement onto an annular step as the valve stem moves from its first to second position to close said second fluid transfer passageway to fluid flow, wherein the liquid discharge element is spherical;

wherein the liquid discharge element is free from physical contact with a return spring.

2. A discharge assembly as claimed in claim 1 wherein the seal is provided on the exterior of the body of the valve stem and the annular step is provided on the interior surface of the housing.

3. A discharge assembly as claimed in claim 2 wherein the seal is an O-ring.

4. A discharge assembly as claimed in claim 2 wherein the seat is downwardly inclined away from the second end of the housing.

5. A discharge assembly as claimed in claim 1 wherein the liquid discharge element is moveable by a returning force from its liquid discharged position to its liquid primed position.

6. A discharge assembly as claimed in claim 5 wherein the liquid discharge element is negatively buoyant in the liquid to be dispensed so as to provide at least a part of said returning force.

7. A discharge assembly as claimed in claim 1 wherein the head portion is moveable within an annular seal provided at the second end of the housing and said head portion has an open-topped conduit communicating with an outlet of the head portion, said open-topped conduit being external of the housing in the first position of the valve stem and within the housing in the second position thereof.

8. A discharge assembly as claimed in claim 1 wherein the inlet to the housing is coaxial with said chamber.

9. A discharge assembly as claimed in claim 8 which is such that with the valve stem in its second limit position and the discharge element at its liquid primed position there is a refill flow passageway arrangement between the liquid inlet of the housing and the chamber provided within the body of the valve stem to permit re-filling of a container on which the discharge assembly is mounted in use, and wherein (a) a tubular spigot is provided within the elongate tubular housing around the liquid inlet thereof, and (b) said refill passageway arrangement is provided by at least one cut away portion of said tubular spigot and at least one slot of the chamber accessible to fluid when the discharge element is at its liquid primed position.

10. A discharge assembly as claimed in claim 1 which is such that with the valve stem in its second limit position and the discharge element at its liquid primed position there is a refill flow passageway arrangement between the liquid inlet of the housing and the chamber provided within the body of the valve stem to permit re-filling of a container on which the discharge assembly is mounted in use.

11. A liquid dispensing apparatus provided with a discharge assembly as claimed in claim 1 for discharging the metered volume of a liquid held in a pressurised or pressurisable container of the apparatus.

12. A liquid dispensing apparatus as claimed in claim 11 wherein the container is pressurised with nitrogen, air, liquefied natural gas, liquefied hydrocarbon gas or carbon dioxide.

13. A liquid dispensing apparatus as claimed in claim 11 which is an aerosol spraying device.

14. A liquid dispensing apparatus as claimed in claim 11 which contains a material selected from the group consisting of pharmaceutical, agrochemical, fragrance, air freshener, odour neutraliser, sanitizing agent, polish, insecticide, depilatory chemical (such as calcium thioglycolate), epilatory chemical, cosmetic agent, deodorant, anti-perspirant, antibacterial agents, anti-allergenic compounds, and mixtures of two or more thereof.

15. A liquid dispensing apparatus as claimed in claim 11 which contains a foamable composition.

16. A liquid dispensing apparatus with a discharge assembly for discharging a metered volume of a liquid held in a pressurised container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position wherein the discharge assembly is as claimed in claim 1.

17. A liquid dispensing apparatus with a discharge assembly for discharging a metered volume of a liquid held in a pressurised container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position, wherein the liquid discharge element is spherical;

wherein the liquid discharge element is free from physical contact with a return spring.

18. Apparatus as claimed in claim 17 which comprises:

(i) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus, and (ii) a valving arrangement such that when the valve stem is in its first limit position liquid may not flow out of the metering chamber through the inlet/outlet arrangement into the discharge conduit and when the valve stem is in its second limit position liquid may flow out of the metering chamber through the inlet/outlet arrangement into the discharge conduit.

19. Apparatus as claimed in claim 18 wherein the discharge assembly comprises a housing and wherein (i) an annular space is provided between the inner surface of the housing and the outer surface of the valve stem, (ii) the metering chamber comprising the liquid discharge element is provided internally to the valve stem.

20. A liquid dispensing apparatus as claimed in claim 19 wherein (i) the housing is an elongate tubular housing having a liquid inlet at a first end thereof, (ii) the valve stem has a body located within said housing and having a portion projecting from the second end of said housing, (iii) the metering chamber has a liquid inlet at a first end of the chamber adjacent said first end of the housing and a first fluid transfer passageway towards the opposite, second end of the chamber, said first fluid transfer passageway providing communication between the chamber and the exterior of the valve stem, (iv) the exterior of the body of the valve stem and the interior of the housing are configured such that in the first position of the valve stem there is second fluid transfer passageway along the outside of the valve stem between the inlet of the housing and a head portion of said valve stem, and (v) the valving arrangement comprises a seal provided for relative sliding movement onto a seat as the valve stem moves from its first to second position to close said second fluid transfer passageway to fluid flow.

* * * * *